US006127931A

United States Patent [19]

Mohr

[11] Patent Number: 6,127,931

[45] Date of Patent: Oct. 3, 2000

[54] DEVICE FOR MONITORING THE MOVEMENT OF A PERSON

[76] Inventor: Robert Mohr, 2767 Audubon Rd., Audubon, Pa. 19403

[21] Appl. No.: 09/375,184

[22] Filed: Aug. 16, 1999

[51] Int. Cl.[7] ..... G08B 23/00

[52] U.S. Cl. ..... 340/573.4; 340/573.1; 340/573; 340/539; 340/574; 340/693

[58] Field of Search ..... 340/573.4, 573.1, 340/573, 539, 574, 693

[56] References Cited

U.S. PATENT DOCUMENTS

| | | | |
|---|---|---|---|
| 4,899,135 | 2/1990 | Ghahariian | 340/573 |
| 5,119,072 | 6/1992 | Hemingway | 340/573 |
| 5,289,163 | 2/1994 | Perez et al. | 340/539 |
| 5,337,041 | 8/1994 | Friedman | 340/573 |
| 5,461,365 | 10/1995 | Schlager et al. | 340/573 |
| 5,525,967 | 6/1996 | Azizi et al. | 340/573 |
| 5,652,569 | 7/1997 | Gerstenberger et al. | 340/573 |
| 5,661,460 | 8/1997 | Sallen et al. | 340/573 |
| 5,689,240 | 11/1997 | Traxler | 340/573 |
| 5,708,421 | 1/1998 | Boyd | 340/573 |
| 5,714,932 | 2/1998 | Castellon et al. | 340/539 |
| 5,812,056 | 9/1998 | Law | 340/539 |
| 5,841,352 | 11/1998 | Prakash | 340/573 |
| 5,900,817 | 5/1999 | Olmassakian | 340/573.1 |

*Primary Examiner*—Daniel J. Wu
*Assistant Examiner*—Tai T. Nguyen
*Attorney, Agent, or Firm*—Michael I Kroll

[57] ABSTRACT

A device for monitoring the movement of a person including a homing unit and a base unit. The homing unit includes a device for generating a homing signal and a transmitter for transmitting the homing signal at predetermined intervals. The base unit includes a receiver for receiving the homing signal, a processor for processing the homing signal to determine whether the homing unit is within a predetermined distance from the base unit and generating an alarm signal upon determining the homing unit is at a distance from the base unit greater than the predetermined distance. An alarm is provided on the base unit for alerting a user that the homing unit has moved a distance greater than the predetermined distance from the base unit upon receipt of the alarm signal from the processor. The alarm is at least one of an audible alarm, a visible alarm and a vibratory alarm. At least one of the base unit and homing unit includes a device for adjusting the predetermined distance. The processor determines a time between receipt of sequentially transmitted homing signals to determine the distance between the base unit and homing unit. The base unit further includes a display for displaying the distance between the base unit and homing unit and a direction to the homing unit from the base unit.

13 Claims, 7 Drawing Sheets

FIG 6

FIG 6A

FIG 6B

S2 GRASP HOMING DEVICE AND SET DESIRED MONITORING RANGE

S4 TURN ON HOMING DEVICE AND SECURE TO PERSON TO BE MONITORED

S6 TURN ON BASE UNIT BY PLACING POWER SWITCH IN ON POSITION

S8 HOMING DEVICE CONSTANTLY TRANSMITS SIGNAL TO BASE UNIT AT PREDETERMINED INTERVALS

S10 TRANSMITTED SIGNALS ARE RECEIVED BY RECEIVER IN BASE UNIT

S12 MICROPROCESSOR ANALYZES SIGNALS FOR STRENGTH AND TIME BETWEEN RECEIPT OF SUBSEQUENTLY TRANSMITTED SIGNALS TO DETERMINE IF HOMING UNIT IS WITHIN MONITORING AREA . POSITION INDICATOR WILL DETERMINE LOCATION OF HOMING UNIT

S14 MICROPROCESSOR SENDS SIGNALS TO DIRECTIONAL AND AND DISTANCE INDICATORS INDICATIVE OF DETERMINED DIRECTION AND DISTANCE OF HOMING UNIT

S16 DIRECTION AND DISTANCE OF HOMING UNIT IS DISPLAYED ON BASE UNIT

CONT'D

FIG 6A

DEVICE FOR MONITORING THE MOVEMENT OF A PERSON

BACKGROUND OF THE INVENTION

1. Field of the Invention

The present invention relates generally to tracking devices and, more specifically, to a device able to track when a person such as a child has roamed a predetermined distance from the base unit and generates an alarm signal upon leaving the monitored area.

2. Description of the Prior Art

Numerous types of tracking devices have been provided in the prior art. Throughout history people have been attempting to keep track of other persons such as children attempting to make sure they are safe and remain within a reasonable distance of their guardian. Such devices attempt to aid a guardian in watching over a child in an attempt to prevent any danger from affecting the child. Devices for monitoring a child have included transmitting devices which are positioned in a child's room while the guardian is in possession of the receiver in another room. Such a device is mainly helpful with infants and is unable to monitor the movements of children once they are able to crawl or walk. Other devices are obtrusive and hard to secure to the child. These devices are bothersome to the child and restrict the movement of the child thus exposing the child to potential danger. Furthermore, as these devices are obtrusive and burdensome the child is likely to attempt to remove such devices thereby negating their effectiveness. While these units may be suitable for the particular purpose to which they address, they would not be as suitable for the purposes of the present invention as heretofore described.

It is thus desirable to provide a device for monitoring the movement of a person which is unobtrusive and can be easily secured to the person or child being monitored. It is further desirable to provide a device for monitoring the movement of a person which is able to produce at least one of an audible, visible or vibratory alarm signal when the person has roamed outside a predetermined monitoring area. It is yet further desirable to provide a device for monitoring the movement of a person which is able to indicate a direction and distance of the person being monitored from the base unit.

SUMMARY OF THE PRESENT INVENTION

The present invention relates generally to tracking devices and, more specifically, to a device able to monitor movement of a person and determine when the person such as a child has roamed a predetermined distance from the base unit, generating an alarm signal upon detecting the person has left the monitoring area.

A primary object of the present invention is to provide a device for monitoring the movement of a person that will overcome the shortcomings of prior art devices.

Another object of the present invention is to provide a device for monitoring the movement of a person which is able to determine when a person has roamed outside a monitoring area.

A further object of the present invention is to provide a device for monitoring the movement of a person which is able to generate an alarm signal upon determining the person being monitored has roamed outside the monitoring area.

A yet further object of the present invention is to provide a device for monitoring the movement of a person including a base unit and a homing unit, the homing unit constantly transmitting a signal at predetermined intervals to the base unit.

A still further object of the present invention is to provide a device for monitoring the movement of a person including an audible alarm for producing an audible signal when the homing unit has moved outside the monitored area whereby the signal transmitted thereby does not reach the base unit within a predetermined time period after receipt of a previously transmitted signal.

A further object of the present invention is to provide a device for monitoring the movement of a person having a visible alarm indicator for producing a visible alarm signal when the homing unit has moved outside the monitored area.

A yet further object of the present invention is to provide a device for monitoring the movement of a person having a vibratory alarm indicator for producing a vibratory alarm signal when the homing unit has moved outside the monitored area.

A further object of the present invention is to provide a device for monitoring the movement of a person wherein a child can be monitored to remain within a safe distance of a guardian and thus minimize the possibility of danger to the child.

A still further object of the present invention is to provide a device for monitoring the movement of a person wherein a strength of the signal transmitted by the homing unit can be changed to define the size of the monitoring area.

Another object of the present invention is to provide a device for monitoring the movement of a person that is simple and easy to use.

A still further object of the present invention is to provide a device for monitoring the movement of a person that is economical in cost to manufacture.

Additional objects of the present invention will appear as the description proceeds.

A device for monitoring the movement of a person is disclosed by the present invention. The device includes a homing unit and a base unit. The homing unit includes a device for generating a homing signal and a transmitter for transmitting the homing signal at predetermined intervals. The base unit includes a receiver for receiving the homing signal, a processor for processing the homing signal to determine whether the homing unit is within a predetermined distance from the base unit and generating an alarm signal upon determining the homing unit is at a distance from the base unit greater than the predetermined distance and an alarm for alerting a user that the homing unit has moved a distance greater than the predetermined distance from the base unit upon receipt of the alarm signal from the processor. The alarm is at least one of an audible alarm, a visible alarm and a vibratory alarm. At least on of the base unit and homing unit includes a device for adjusting the predetermined distance. The processor determines a time between receipt of sequentially transmitted homing signals to determine the distance between the base unit and homing unit. The base unit further includes a display for displaying the distance between the base unit and homing unit and a direction to the homing unit from the base unit.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
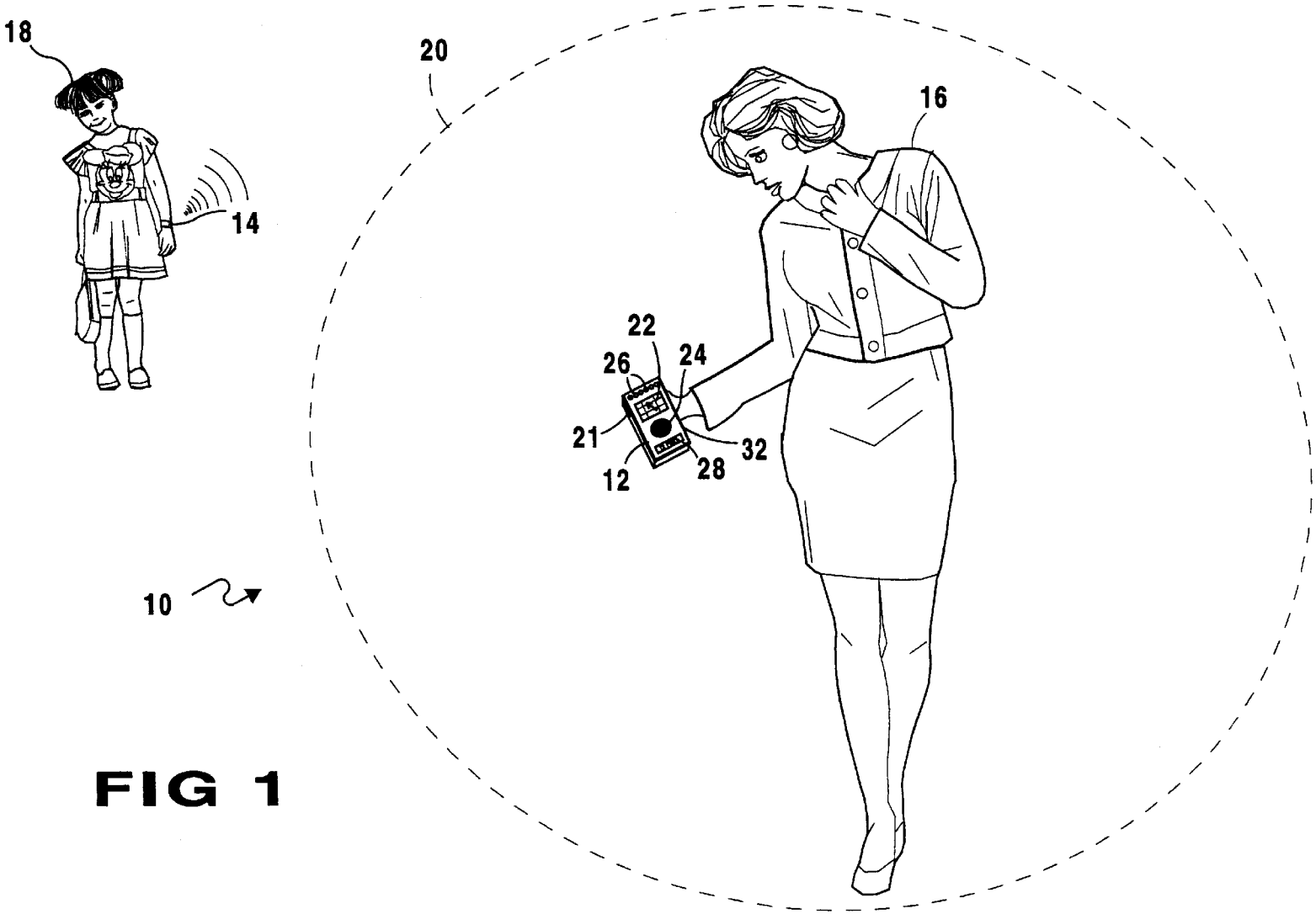
FIG. 1 is a perspective view of a child wearing the homing unit and a guardian monitoring the movements of the child with the base unit of device for monitoring the movement of a person of the present invention.

Turning now descriptively to the drawings, in which similar reference characters denote similar elements throughout the several views, the Figures illustrate the device for monitoring the movement of a person of the present invention. With regard to the reference numerals used, the following numbering is used throughout the various drawing figures.

10 device for monitoring the movement of a person of the present invention
12 base unit
14 homing transmitter unit
16 guardian
18 child being monitored
20 range of monitoring area
21 power switch
22 directional indicator on base unit
24 audible alarm on base unit
26 visible alarm on base unit
28 distance indicator on base unit
30 clip on homing device for securing to clothing or jewelry
32 range control switch for base unit
33 indicia on range control switch for base unit
34 microprocessor of base unit for base unit
35 control knob of range control switch
36 power source of base unit
38 receiver of base unit
40 vibratory alarm of base unit
41 position sensor
42 microprocessor of homing transmitter unit
44 power source of homing transmitter unit
45 power switch of homing transmitter unit
46 transmitter of homing transmitter unit
48 range control switch of homing transmitter unit
50 indicia on range control switch of homing transmitter unit
52 microprocessor of base unit of homing transmitter unit

DETAILED DESCRIPTION OF THE PREFERRED EMBODIMENT

Turning now descriptively to the drawings, in which similar reference characters denote similar elements throughout the several views, FIGS. 1 through 5 illustrate the device for monitoring the movement of a person of the present invention indicated generally by the numeral 10.

The device for monitoring the movement of a person 10 is shown in FIG. 1. The device for monitoring the movement of a person 10 includes a base unit 12 and a homing transmitter unit 14. The base unit 12 is held by a user or guardian 16 and the homing transmitter unit 14 is worn by a person 18 being monitored. The device for monitoring the movement of a person 10 will monitor the movements of a person 18 being monitored within a predetermined area 20 and generate an alarm signal when the person 18 being monitored travels outside the predetermined area 20. The size of the predetermined area is variable and may be set based upon the amount of freedom the user or guardian 16 wishes to provide the person 18 being monitored. The device for monitoring the movement of a person 10 may be used to monitor a child or any other person such as a criminal restricted to remain within a predetermined area or the like.

The base unit 12 includes a power switch 21 to turn the base unit 12 on thereby connecting the power source to the base unit 12 and allowing the guardian 16 to begin monitoring movement of the person 18 within the monitoring area 20. A directional indicator 22 is positioned on the base unit 12 to provide a display indicating the location of the homing transmitter 14 with respect to the base unit 12. A speaker 24 is provided for producing an audible alarm signal alerting the guardian 16 that the person 18 being monitored has traveled outside the monitoring area 20. A visual alarm 26 is also provided on the base unit 12 for producing a visible alarm alerting the guardian 16 that the person 18 being monitored has traveled outside the monitoring area 20. A distance indicator 28 is also provided to indicate the distance of the person 18 being monitored from the base unit 12. Furthermore, a range control switch 32 is provided on the face side of the base unit 12 for manually adjusting the circumference of the circle defining the monitoring area 20.

Figure 2:
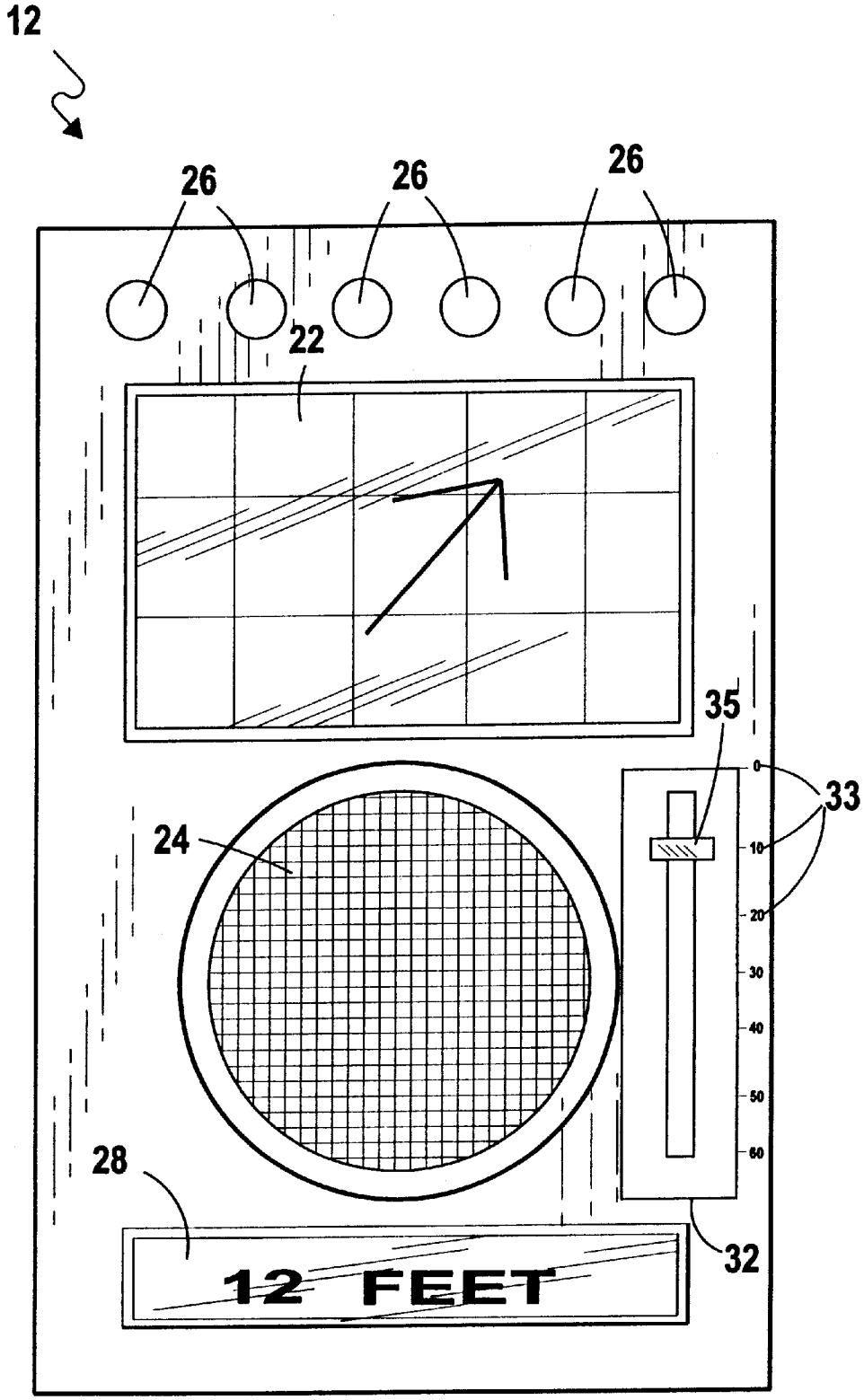
FIG. 2 is a front perspective view of the base unit of the device for monitoring the movement of a person of the present invention.

A front view of the base unit 12 is illustrated in FIG. 2. From this view the elements provided on the face side of the base unit 12 are readily seen. The directional indicator 22 is positioned on the face side of the base unit 12 to provide a display indicating the location of the homing transmitter unit 14 with respect to the base unit 12. An arrow 23 is illustrated indicating the direction at which the homing transmitter unit 14 is positioned with respect to the base unit 12. The speaker 24 is positioned on the face side of the base unit 12 and is provided to produce an audible alarm signal alerting the guardian 16 when the person 18 being monitored has traveled outside the monitoring area 20. The distance indicator 28 is also provided to indicate the distance of the person 18 being monitored from the base unit 12. The range control switch 32 includes indicia 33 indicating the distance from the base unit 12 within which the person 18 being monitored may roam freely without activating the audible and visual alarm. A manual knob 35 is also provided to set the size of the monitoring area 20. The guardian 16 will set the control knob 35 to align with the indicia 33 indicating the desired size for the monitoring area 20. The control knob 35 is illustrated as a slideable tab for purposes of example only. However, any suitable control knob 35 may be used for manually setting the size of the monitoring area 20. The visual alarm 26 preferably consists of a plurality of light emitting diodes and is also positioned on the face side of the base unit 12 for producing a visible alarm alerting the guardian 16 that the person 18 being monitored has traveled outside the monitoring area 20. The use of light emitting diodes for producing the visual alarm signal is for purposes of example only.

While a preferred structure for the visual alarm is shown and described herein, those of ordinary skill in the art who have read this description will appreciate that there are numerous other structures for the visual alarm and, therefore, as used herein the phrase "means for producing a visual alarm signal" should be construed as including all such structures as long as they achieve the desired result of producing a visual alarm signal, and therefore, that all such alternative mechanisms are to be considered as equivalent to the one described herein.

Figure 3:
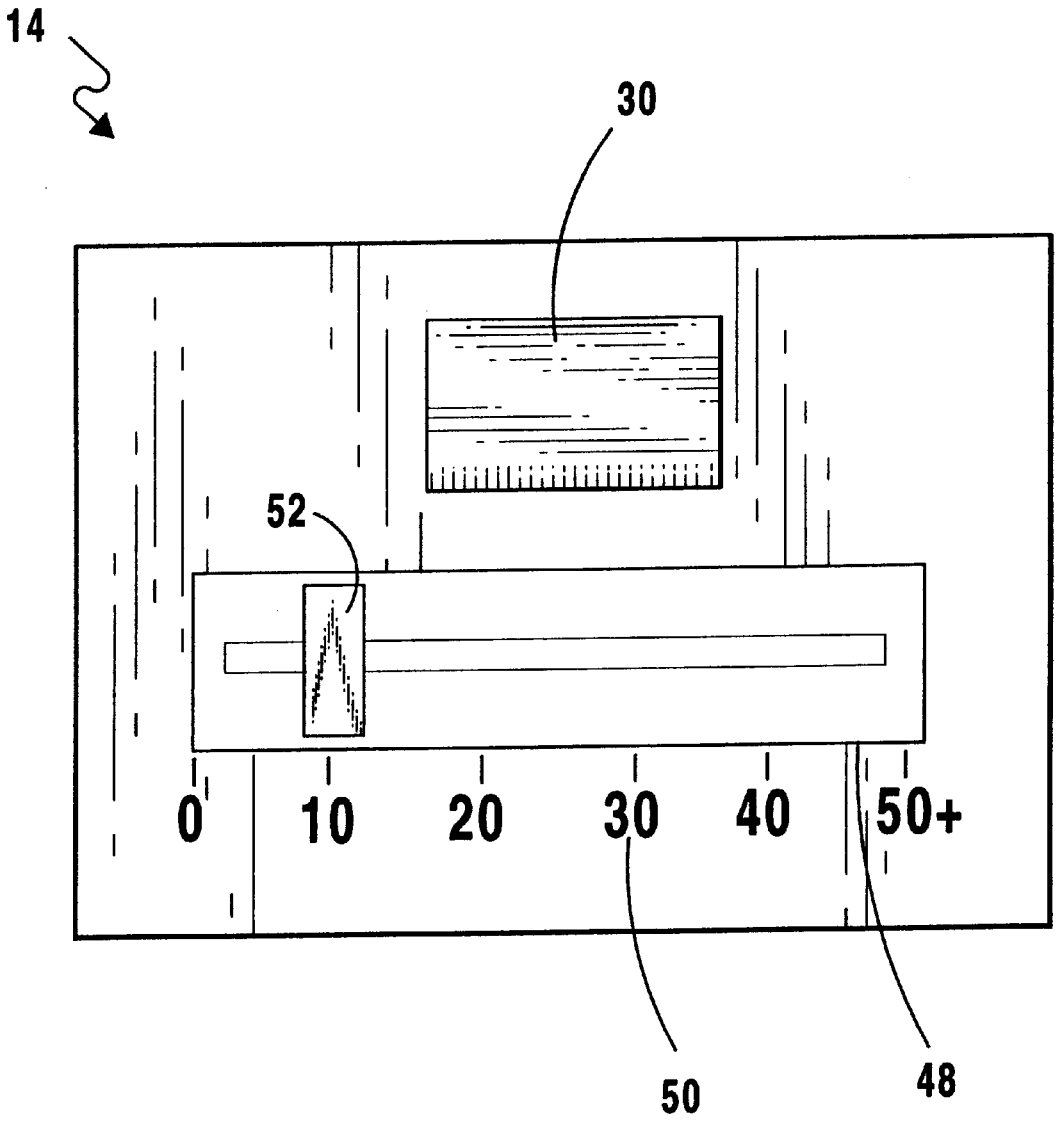
FIG. 3 is a front perspective view of the homing unit of the device for monitoring the movement of a person of the present invention.

An enlarged view of the homing transmitter unit 14 is illustrated in FIG. 3. Positioned on an outer side of the homing transmitter unit 14 is a clip 30 for securing the homing transmitter unit 14 to a piece of clothing of the person 18 being monitored. Alternatively, a strap or belt may be used to secure the homing transmitting unit 14 to the person 18 being monitored.

While a preferred structure for securing the homing transmitting unit 14 to the person 18 being monitored is shown and described herein, those of ordinary skill in the art who have read this description will appreciate that there are numerous other structures for securing the homing transmitting unit 14 to the person 18 being monitored and, therefore, as used herein the phrase "means for securing the homing transmitting unit 14 to the person 18 being monitored" should be construed as including all such structures as long as they achieve the desired result of securing the homing transmitting unit 14 to the person 18 being monitored, and therefore, that all such alternative mechanisms are to be considered as equivalent to the one described herein.

The homing transmitter unit 14 may also include a range control switch 48 including indicia 50 indicating the strength of the signal to be transmitted thereby. The signal strength will determine the size of the monitoring area 20. A manual knob 52 is provided to set the strength of the signal and thus set the size of the monitoring area 20. The guardian 16 will set the control knob 52 to align with the indicia 50 indicating the desired monitoring area 20. The control knob 52 is illustrated as a slideable tab for purposes of example only. However, any suitable control knob 52 may be used for manually setting the size of the monitoring area 20.

Figure 4:
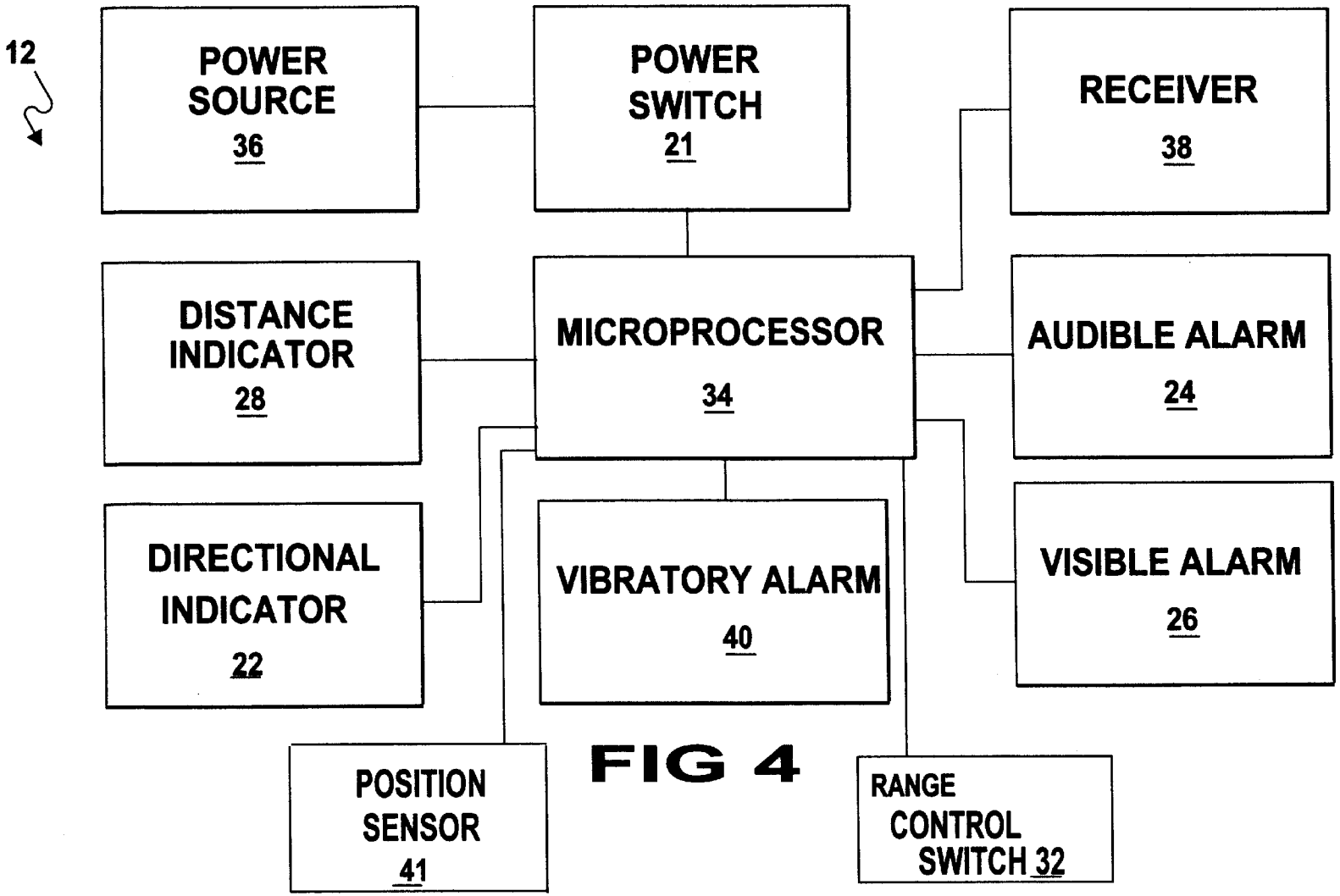
FIG. 4 is a block diagram of the base unit of the device for monitoring the movement of a person of the present invention.

A block diagram illustrating the components forming the base unit 12 is illustrated in FIG. 4. As seen from this figure, the base unit 12 includes a microprocessor 34. The microprocessor 34 is connected to a power source 36 through the power switch 21. When the power switch 21 is activated power is supplied to the microprocessor 34 and the base unit 12 will begin monitoring signals received from the homing transmitter unit 14. A receiver 38 is connected to the microprocessor 34 for receiving the signals transmitted by the homing transmitter unit 14. The signals received by the receiver 38 are provided to the microprocessor 34 for analysis. The range control switch 32 is connected to the microprocessor 34 for setting the size of the monitoring area. The microprocessor will then determine if the homing transmitter unit 14 is within the preset monitoring area 20. The audible alarm 24 and visible alarm 26 are connected to receive alarm signals from the microprocessor 34 upon a determination that the homing transmitter unit 14 is outside the monitoring area 20. A vibratory alarm 40 is also connected to the microprocessor 34 for receiving an alarm signal therefrom and causing the base unit 12 to vibrate when it is determined that the homing transmitter unit 14 is outside the monitoring area 20. A position sensor is connected to the microprocessor 34 for determining the position of the homing transmitter unit 14 with respect to the base unit 12 and generates a position signal for transmission to the microprocessor 34. The position signal indicates the position and distance of the homing transmitter unit 14 with respect to the base unit 12. The microprocessor 34 will analyze the position signal and generate a direction signal and a distance signal. The directional indicator 22 is connected to receive the direction signal from the microprocessor 34 and in response thereto displays an arrow pointing in the direction of the homing transmitter unit 14. The distance indicator 28 is also connected to the microprocessor 34 for receiving the distance signal. The distance indicator 28 will display a distance at which the homing transmitting unit 14 is positioned from the base unit 12 in response to receipt of the distance signal.

Figure 5:
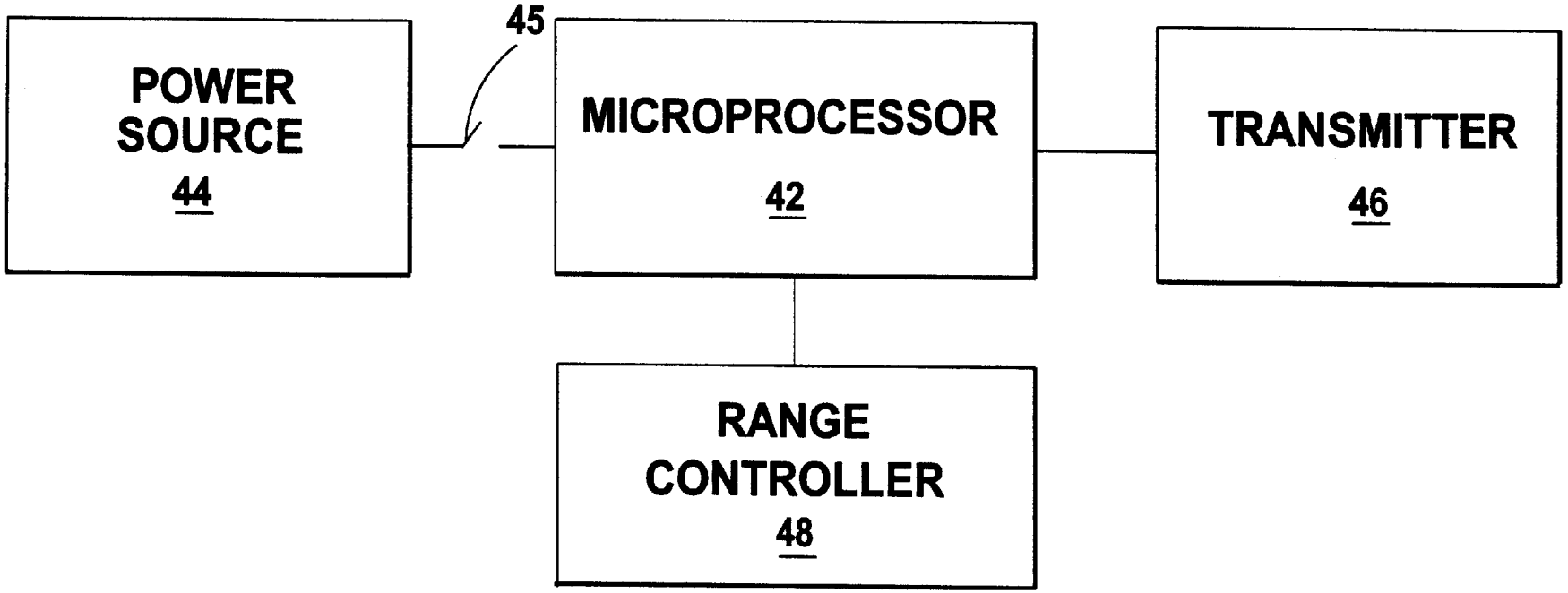
FIG. 5 is a block diagram of the homing unit of the device for monitoring the movement of a person of the present invention.

A block diagram of the homing transmitter unit 14 is illustrated in FIG. 5. The homing transmitter unit 14 includes a microprocessor 42 connected to both a power source 44 and a transmitter 46. The power source 44 is connected to the microprocessor 42 via a power switch 45. The microprocessor 42 will generate a signal to be transmitted by the transmitter 46 at predetermined intervals. A range controller 48 may also be connected to the microprocessor 42 for setting the signal strength of the signal to be transmitted. By setting the signal strength at a particular value, the homing signal will not be strong enough to reach the base unit 12 when the person 18 being monitored leaves the monitoring area 20.

Figure 6B:
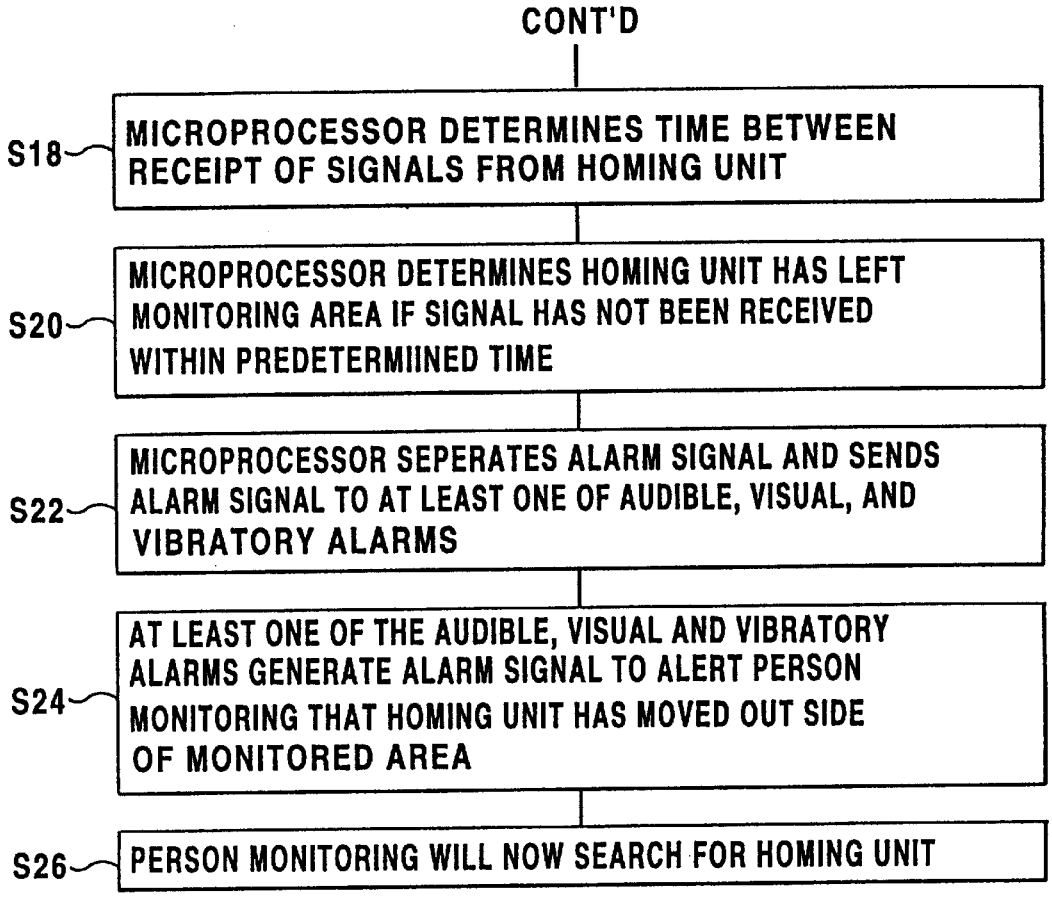
FIG. 6 is a flow chart illustrating use of the device for monitoring the movement of a person of the present invention.

The operation of the device for monitoring the movement of a person 10 will now be described with reference to the figures and specifically FIG. 6. In operation, the homing transmitter unit 14 is grasped by a user and a desired monitoring range is set if a range control switch 48 is connected to the homing transmitter unit 14 as described in step S2. Alternatively, the base unit 12 may include a range control switch 32 for setting the size of the monitoring area 20. The range control switch 48 on the homing transmitter unit 14 sets a signal strength at which the homing signal will be transmitted and the range control switch 32 in the base unit 12 will set a time period within which a homing signal must be received. Each time a homing signal is received, a timer within the microprocessor 34 will be reset indicating the signal was transmitted from within the monitoring area. The homing transmitter unit 14 is then secured to the person 18 to be monitored and the power switch 45 is turned on to connect the microprocessor 42 to the power source 44 as stated in step S4. The base unit 12 is then turned on to monitor a person by activating the power switch 21 as discussed in step S6. The device for monitoring the movement of a person 10 is now ready for use.

The homing transmitter unit 14 will constantly send homing signals to the base unit 12 at predetermined intervals as described in step S8. The strength of the homing signals may be determined by a range control switch 48 on the homing transmitter unit 14. The transmitted homing signals are received by the receiver 38 in the base unit 12 as stated in step S10. The received homing signals are sent to the microprocessor 34 and analyzed to determine if the homing signals are received within the predetermined time period as described in step S12. Based upon the interval between received homing signals the microprocessor 34 will determine if the homing transmitter unit 14 and thus the person 18 being monitored is within the monitoring area 20. The position indicator will determine the position of the homing transmitter unit 14, i.e. direction and distance, with respect to the base unit 12.

The microprocessor 34 will now send signals to the directional indicator 22 indicative of the determined direction of the homing unit 14 and to the distance indicator 28 indicative of the determined distance of the homing transmitter unit 14 as stated in step S14. The direction and distance of the homing transmitter unit 14 will be displayed on the direction indicator 22 and distance indicator 28, respectively, as discussed in step S16. The microprocessor 34 will now determine the time between receipt of homing signals from the homing unit 14 as described in step S18. The time period within which sequentially transmitted signals may be received is determined by the range control switch 32 on the base unit 12. Should sequentially transmitted signals not be received within the predetermined time period, the microprocessor 34 will determine that the homing transmitter unit 14 has left the monitoring area as stated in step S20. Upon determining the homing transmitter unit 14 has left the monitoring area 20, alarm signals will be transmitted to at least one of the audible alarm 24, visual alarm 26 and vibratory alarm 40 as discussed in step S22. Upon receipt of the alarm signal the at least one of the audible alarm 24, visual alarm 26 and vibratory alarm 40 will generate an alarm to alert the user 16 that the homing transmitter unit has exited the monitoring area 20 as described in step S24. The user 16 will now go to search for the homing transmitter unit 14 using the direction indicator 22 and distance indicator as a guide for determining the location as stated in step S26.

From the above description it can be seen that the device for monitoring the movement of a person of the present invention is able to overcome the shortcomings of prior art devices by providing a device for monitoring the movement of a person which is able to determine when a person has roamed outside a monitoring area and generate an alarm signal upon determining the person being monitored has roamed outside the monitoring area and wherein a child can be monitored to remain within a safe distance of a guardian and thus minimize the possibility of danger to the child. The device for monitoring the movement of a person includes a base unit and a homing unit, the homing unit constantly transmitting a signal at predetermined intervals to the base unit. The device for monitoring the movement of a person also includes an audible alarm for producing an audible signal when the homing unit has moved outside the monitored area whereby the signal transmitted thereby does not reach the base unit within a predetermined time period after receipt of a previously transmitted signal, a visible alarm indicator for producing a visible alarm signal when the homing unit has moved outside the monitored area and a vibratory alarm indicator for producing a vibratory alarm signal when the homing unit has moved outside the monitored area. Furthermore, the device for monitoring the movement of a person of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A device for monitoring the movement of a person, said device comprising:

a) a homing unit including:

i) means for independently generating a homing signal; and ii) means for transmitting said homing signal at predetermined intervals;

b) a base unit including:

i) means for receiving said homing signal;

ii) means for processing said homing signal to determine whether said homing unit is within a predetermined distance from said base unit and generating an alarm signal upon determining said homing unit is at a distance from said base unit greater than said predetermined distance, said processing means determining a time between receipt of the sequentially transmitted homing signals and strength of said signal to determine a distance between said base unit and said homing unit;

iii) means for alerting a user that said homing unit has moved a distance greater than said predetermined distance from said base unit upon receipt of said alarm signal from said processing means;

iv) means for adjusting said predetermined distance;

v) means for adjusting a reference time period utilized by said processing means for determining said predetermined distance; and c) means in said homing unit for establishing the monitoring area by setting the strength of the homing signal.

2. The device for monitoring the movement of a person as recited in claim 1, wherein said means for adjusting includes a manually activated knob for adjusting said predetermined distance.

3. The device for monitoring the movement of a person as recited in claim 2, wherein said adjusting means further includes indicia for aiding a user in setting said predetermined distance.

4. The device for monitoring the movement of a person as recited in claim 1, wherein said alerting means is at least one of an audible alarm, a visible alarm and a vibratory alarm.

5. The device for monitoring the movement of a person as recited in claim 4, wherein said visual alarm includes a plurality of light emitting diodes.

6. The device for monitoring the movement of a person as recited in claim 1, wherein said base unit further includes means for displaying said distance between said base unit and said homing unit determined by said processing means.

7. The device for monitoring the movement of a person as recited in claim 1, wherein said processing means determines a position of said homing unit with respect to said base unit and generates a directional signal indicating a direction from said base unit to said homing unit.

8. The device for monitoring the movement of a person as recited in claim 7, wherein said base unit further includes means for displaying said direction to said homing unit.

9. The device for monitoring the movement of a person as recited in claim 1, wherein said means for adjusting a signal strength includes a manually activated knob for adjusting said predetermined distance.

10. The device for monitoring the movement of a person as recited in claim 9, wherein said means for adjusting a signal strength further includes indicia for aiding a user in setting said predetermined distance.

11. The device for monitoring the movement of a person as recited in claim 1, wherein said homing unit further includes a clip for releasably securing said homing unit to a person to be monitored.

12. The device for monitoring the movement of a person as recited in claim 1, wherein said homing unit further includes a strap for releasably securing said homing unit to a person to be monitored.

13. The device for monitoring the movement of a person as recited in claim 1, wherein said base unit is a hand held unit.

* * * * *